United States Patent [19]

Hildebrant et al.

[11] 4,092,187

[45] May 30, 1978

[54] PROCESS FOR COATING CRYSTALLINE HIGH EXPLOSIVES

[75] Inventors: Floyd J. Hildebrant, Andover; Bernard R. Banker, Mine Hill, both of N.J.

[73] Assignee: The United States of America as represented by the Secretary of the Army, Washington, D.C.

[21] Appl. No.: 715,279

[22] Filed: Aug. 18, 1976

[51] Int. Cl.[2] ..... C06B 45/22

[52] U.S. Cl. ..... 149/11; 427/212; 427/215

[58] Field of Search ..... 149/11, 12; 427/212, 427/222; 252/316

[56] References Cited

U.S. PATENT DOCUMENTS

| | | | |
|---|---|---|---|
| 2,419,512 | 4/1947 | Vesce | 260/42.55 |
| 2,607,753 | 8/1952 | Adams | 260/42.55 |
| 2,719,153 | 9/1955 | Schulz | 260/248 NS |
| 3,348,986 | 10/1967 | Sauer | 149/12 |
| 3,455,749 | 7/1969 | Gow | 149/11 |
| 3,704,185 | 11/1972 | Cooner | 149/11 |
| 3,740,278 | 6/1973 | Sakreis | 149/11 |
| 3,772,249 | 11/1973 | Morgans | 260/42.55 |

FOREIGN PATENT DOCUMENTS

| | | |
|---|---|---|
| 574,271 | 12/1945 | United Kingdom. |

*Primary Examiner*—Ronald H. Smith
*Assistant Examiner*—S. Silverberg
*Attorney, Agent, or Firm*—Nathan Edelberg; Harold H. Card, Jr.; A. Victor Erkkila

[57] ABSTRACT

Finely divided, crystalline high explosive compounds and compositions are provided with a desensitizing coating of wax by mixing the explosive particles with an aqueous dispersion of the wax containing a soluble salt of a higher fatty acid dispersing agent, e.g. sodium stearate, and adding barium chloride or the like to precipitate the dispersing agent as a water-insoluble fatty acid compound and break the dispersion, thereby coating the explosive particles with an intimate mixture of the wax and the insoluble fatty acid compound.

5 Claims, No Drawings

PROCESS FOR COATING CRYSTALLINE HIGH EXPLOSIVES

GOVERMENTAL INTEREST

The invention described herein may be manufactured, used, and licensed by or for the Gorverment for Governmental purposes without the payment to us of any royalities thereon.

BACKGROUND OF THE INVENTION

Crystalline high explosives, such as RDX, HMX, PETN, TNT, Composition B are usually desensitized by coating the particles thereof with a small amount, e.g. 1–10% by weight, of a wax phlegmatizing material. A number of methods have been utilized for producing such desensitizer coatings on particulate explosives. According to one method the explosive particles and the wax are slurried in water heated to a temperature above the melting point of the wax and the wax is deposited on the explosive particles on cooling. However, the explosive particles obtained thereby are unevenly coated and adhered together in small lumps, which if broken during handling or transport, expose the explosive surface, and thus increases the sensitivity of the explosive. A more uniform coating of the wax or other desensitizing material can be obtained by employing an aqueous dispersion of the wax obtained by means of a dispersing or emulsifying agent (British Pat. No. 574,271 and U.S. Pat. No. 3,740,278). Another method comprises mixing the explosive particles with a solution of the wax or other desensitizing material in a volatile organic solvent, such as heptane, as such or as an aqueous emulsion thereof in water, and separating the coated explosive particles from the solvent and/or aqueous medium. While this method provides a fairly satisfactory coating, it has some significant disadvantages, notably, the solvents employed are costly and, although not toxic, must be vented and recovered; and the removal of the organic solvent and water by evaporation is time-consuming — all of which adds to the expense of the method (British Pat. No. 776,539, U.S. Pat. Nos. 3,348,986 and 3,544,360). It is also known to coat the explosive particles with a desensitizing material consisting of calcium stearate obtained by adding calcium chloride to an aqueous mixture of the explosive particles and sodium stearate (U.S. Pat. Nos. 2,719,153 and 3,266,957).

SUMMARY AND DETAILED DESCRIPTION OF THE INVENTION

An object of the present invention is to provide a novel process for coating particulate, crystalline high explosive compounds and compositions, such as RDX (cyclotrimethylenetrinitramine), HMX (cyclotetramethylenetetranitramine), PETN (pentaerythritol tetranitrate), tetryl (2,4,6-trinitrophenylmethylnitramine), TNT (2,4,6-trinitrotoluene) and mixtures thereof, such as Composition B (60% RDX + 40% TNT), with a wax desensitizing material, which reduces or eliminates the disadvantages of prior art methods.

Another object is to provide a particulate high explosive containing an improved coating of desensitizing material.

Other objects will become apparent as the invention is further described.

In accordance with the present invention these and other objects are accomplished by a process, which comprises mixing the crystalline high explosive particles with an aqueous dispersion containing the normally solid wax desensitizing material and a dispersing agent comprising a water-soluble salt of a higher fatty acid, such as ammonium stearate, and adding a water-soluble acid or polyvalent metal salt, e.g. $BaCl_2$, to precipitate the dispersing agent as the water-insoluble fatty acid or polyvalent metal salt thereof and break the dispersion, thereby coating the particles of explosive with an intimate composite of the wax and the solid, insoluble fatty acid or polyvalent salt thereof.

The process eliminates the use of solvents and provides a number of important and unexpected advantages over the prior art dispersion coating process, wherein the particulate explosive is coated with an aqueous emulsion or dispersion of the wax but without precipitation of the dispersing agent as an insoluble salt, e.g.

(1) the individual explosive particles are coated more uniformly and completely;
(2) the coating operation is faster — the dispersion breaks almost immediately after the addition of the precipitating agent, whereby the process can be readily carried out in batchwise or continuous manner;
(3) The coating operation is more readily controlled, thereby eliminating rejects;
(4) the drying time for the filter cake of coated particulate explosive is materially reduced;
(5) the coating provides greater lubricity, which facilitates compression of the coated particles to pellets of high density;
(6) the particulate explosive containing the composite coating produced according to the present invention possesses good adhesion and cohesion and exhibits reduced exudation and impact sensitivity.

The present process can be carried out by mixing an aqueous slurry of the particulate high explosive in an agitated kettle with a sufficient amount of an aqueous dispersion of the wax containing the fatty acid salt dispersing agent until a uniform blend is obtained. The blend is then mixed with a sufficient amount of a precipitating agent consisting essentially of a water soluble acid or polyvalent metal salt to precipitate the dispersing agent as the insoluble free fatty acid or polyvalent metal salt and break the dispersion, whereby the wax and the insoluble fatty acid or polyvalent metal salt thereof are deposited as an intimate mixture on the surface of the explosive particles. During the incorporation of the precipitating agent the reaction mixture is vigorously agitated to promote complete coverage of the explosive particles with said coating mixture. Preferably, the mixture is further agitated for a short period after addition of the precipitating agent, since it has been found to provide a "milling" action which smooths the surface of the coated particles and thus provides a material of higher bulk density, which facilitates loading and pelleting operations. The coated particles of explosive thus obtained can be removed from the aqueous liquid by filtration or centrifugation, washed with water and dried. The acid precipitating agent is utilized only in the case of a fatty acid salt dispersing agent which in the form of the free acid is solid at ordinary temperatures and preferably possesses a melting point of at least about 50° C. The amount of aqueous dispersion of wax employed should be sufficient to produce a composite coating of the insoluble wax/fatty acid compound amounting to about 1 to 20% by weight of the particulate explosive.

The aqueous dispersion utilized in the present process contains the wax in the form of very fine particles, which are usually at least about ten times smaller than the explosive particles to be coated. Generally, the particulate explosive is employed in the form of particles ranging in average particle size from about 50 to 1000 microns, while the particles of the wax present in the dispersions employed preferably range in average particle size from less than one micron, e.g. 0.1 micron, to about 10 microns. Dispersions containing such finely divided wax can be obtained by grinding or comminuting a coarse aqueous suspension or dispersion of the wax containing the soluble fatty acid dispersing agent, with or without wetting agents, in a colloid mill, ultrasonic or pressure homogenizer or by other known methods. The process can be performed above or below the melting point of the wax by employing an aqueous dispersion containing the wax in the form of solid or liquid particles or droplets of the aforesaid particle size. Preferably, the process is effected by coating the particulate explosive from an aqueous dispersion containing the wax in the form of solid particles, since a more uniform coating of the explosive particles is thereby usually obtained. Further, the process is carried out at a temperature below the melting point and decomposition temperature of the particulate explosive.

Wax desensitizing materials suitable for use in the present process should be compatible with the particulate explosive and are selected from the group consisting of normally solid, water-insoluble natural and synthetic waxes melting preferably above about 50° C., and especially between about 80° C. and 140° C. to minimize exudation from pellets molded from the coated particles. Examples of such materials are paraffin wax, microcrystalline wax, montan wax, beeswax, polyolefin, e.g. polyethylene and polypropylene, waxes of mol. wt. less than 20,000, Fischer-Tropsch waxes, and bis higher fatty acid amides, e.g. bis stearoylamide and bis oleoylamide. Materials containing one or more free carboxylic acid groups in the molecule, such as ethylene-organic acid copolymers, are advantageously employed, since they can react with the polyvalent metal salt, the preferred precipitating agent, and thereby cross-link with the fatty acid to form a particularly effective and desirable desensitizing coating on the particulate explosive. Ordinarily, the coating produced on the particulate explosive by the process of the present invention contains about from 0.05 to 0.5 part of the fatty acid or polyvalent metal salt thereof per part of the wax.

Water soluble salts of fatty acids, which are employed as dispersing agents according to the present process, include for example the ammonium, sodium, potassium, lithium, morpholine, triethanolamine and diethylethanolamine salts of fatty acids, including unsaturated fatty acids, containing at least 10 carbon atoms and preferably not more than 22 carbon atoms. Specific examples of such fatty acids are capric acid, lauric acid, myristic acid, palmitic acid, stearic acid, oleic acid, mixtures of straight and branched fatty acids containing 15 to 20 carbon atoms, obtained by oxidation of straight and branched chain paraffin hydrocarbons of mineral oil fractions, eicosanic acid, behenic acid and cerosic acid. Water soluble acids and polyvalent metal salts, which are employed to precipitate the dispersing agents by formation of the corresponding water-insoluble free fatty acids or polyvalent salts thereof in known manner include a) organic acids, such as acetic acid, and inorganic acids, such as hydrochloric-, sulfuric-, and phosphoric acids, and b) polyvalent metal salts such as barium chloride, calcium chloride, magnesium chloride, zinc chloride, lead chloride, and aluminum chloride.

The following examples illustrate specific embodiments of the method of carrying out the process of the present invention.

EXAMPLE 1

3640 lbs. of U.S. Military Specification Class A RDX of 200 microns average particle size and about 12,000 lbs. of water were charged to a kettle and the mixture was heated to 95° C. with agitation. 1475 lbs. of an aqueous dispersion, obtained by comminuting polyethylene wax to an average particle size 8 microns in water containing a mixture essentially of the ammonium and morpholine salts of stearic, linoleic and oleic acids, were then added while agitating and maintaining the kettle contents at 95° C. The dispersion had the following composition:

| | |
|---|---|
| AC-656 Polyethylene* | 20.4% |
| Acintol® FA-2** Tall Oil Fatty Acid | 3.6% |
| Morpholine | 3.6% |
| Stearic acid | 1.1% |
| Ammonia, 28% | 0.5% |
| Water | 70.8% |
| | 100.0% |

*An oxidized polyethylene homopolymer of softening point 96° C. (ASTM E-28) and acid no. 15, manufactured by Allied Chemical Corp.

**A product manufactured by Arizona Chemical Co. and containing 98.2% total fatty acids consisting of 36% linoleic, non-conjugated, 6% linoleic, conjugated, 47% oleic, 3% saturated and 8% other fatty acids.

After addition of the dispersion was complete, the mixture was agitated for a few minutes and 63 lbs. of barium chloride as a 10% aqueous solution were stirred in at 95° C. The dispersion broke almost immediately. The kettle cotents were then agitated at 95° C. for about 30 minutes (to provide a slight milling effect on the particles, which promoted the production of a product of higher bulk density on compression molding), cooled to 50° C. and filtered. The filter cake was washed with water, passed through a No. 4 U.S. Standard Sieve and dried at 60° C. to 0.1% maximum total volatiles content. The coated particulate RDX product thus obtained contained approximately 10% by weight of the composite wax/barium fatty acid salt coating, and had a bulk density of 0.86 gram/cc.

The product thus obtained showed the following advantages as compared with a product obtained by the prior art process, wherein the RDX was dispersion coated with the wax but without precipitation of the dispersing agent as an insoluble salt, notably:

(1) Examination under a scanning electron microscope showed that the individual RDX particles were coated more uniformly and completely;

(2) The coated RDX particles possessed a higher bulk density, were less sensitive to impact, as determined by the 2 Kg falling weight test; and when press-loaded into projectile shells, showed no exudation on storage at 160° and 180° F. for 45 days.

Further, the coating operation was completed much more rapidly (since the dispersion broke almost immediately on addition of the barium chloride), and the drying time for the filter cake of product was reduced from 4 hours to less than 2 hours.

EXAMPLE 2

3640 lbs. of RDX of the type employed in example 1 and about 12,000 lbs. of water were charged to a kettle and the mixture was heated to 95° C. with agitation. 740 lbs. of an aqueous dispersion, obtained by comminuting a mixture of Fischer-Tropsch waxes to an average particle size of about 8 *u*, in water containing potassium stearate, were then added while agitating and maintaining the kettle contents at 95° C. The dispersion had the following composition:

| | |
|---|---|
| Paraflint R2* | 13.2% |
| Paraflint H1* | 34.0% |
| Stearic acid (70%) | 2.1% |
| Aerosol® OT** | 0.2% |
| KOH (85%) | 0.4% |
| Water | 50.1% |
| | 100.0% |

*Paraflints R2 and H1 are Fischer-Tropsch waxes of congealing points 92° C. and 93-99° C. resp. (ASTM D 938) and manufactured by Moore & Munger Corp.

**Aerosol OT is a sulfosuccinate wetting agent manufactured by American Cyanamid Co.

The resulting mixture was agitated for a few minutes after the addition of the dispersion was complete, and 20 lbs. of barium chloride as a 10% aqueous solution were then added with agitation at 95° C. The dispersion broke almost immediately. The kettle contents were then agitated at 95° C. for 30 minutes, cooled to 50° C. and filtered. The filter cake was washed with water, passed through a No. 4 U.S. Std. Sieve and dried at 60° C. to 0.1% maximum total volatiles content. The coated particulate RDX product thus obtained had a bulk density of 0.82 gram/cc. and possessed properties similar to those of the product of example 1.

EXAMPLE 3

3640 lbs. of RDX of the type used in example 1 and about 12,000 lbs. of water were charged to a kettle and the mixture was heated to 95° C. with agitation. 1350 lbs. of an aqueous dispersion, obtained by comminuting a mixture of polyethylene waxes to an average particle size 8 *u* in water containing a mixture of ammonium stearate and diethylethanolamine stearate, were then introduced with agitation while maintaining the temperature at 95° C. The dispersion had the following composition:

| | |
|---|---|
| AC-580 Polyethylene* | 16.2% |
| Polywax 500** | 9.7% |
| Diethylethanolamine | 1.5% |
| Aerosol® OT (75%) | 0.1% |
| Stearic acid | 1.4% |
| Ammonia (28%) | 0.6% |
| Water | 70.5% |

-continued

| | |
|---|---|
| | 100.0% |

*An ethylene-acrylic acid copolymer wax containing free carboxylic acid groups, possessing an acid no. 75 and a softening point of 102° C. (ASTM E-28), manufactured by Allied Chemical Corporation.

**An ethylene homopolymer of average mol. wt. 500, melting point 85° C. (ASTM D-127) and congealing point 80.5° C. (ASTM D-938) manufactured by the Bareco Division of Petrolite Corp., Tulsa, Oklahoma.

The mixture thus obtained was agitated at 95° C. for about 10 minutes, after which 155 lbs. glacial acetic acid were added, causing the emulsion to break almost immediately. The kettle contents were then agitated at 95° C. for about 45 minutes, cooled to 50° C. and filtered. The filter cake was washed with water, screened and dried at 60° C. to 0.1% maximum total volatiles content. The coated particulate RDX product thus obtained had a bulk density of 0.85 gram/cc. and possessed properties similar to those of the product of example 1.

The foregoing disclosure is merely illustrative of the principles of this invention and is not to be interpreted in a limiting sense. We wish it to be understood that we do not desire to be limited to the exact details of construction shown and described, because obvious modifications will occur to a person skilled in the art.

We claim:

1. A process for producing an improved desensitizing coating on a particulate, crystalline, organic high explosive, which comprises:

a. mixing the particulate explosive with an aqueous dispersion of a normally solid water-insoluble wax containing at least one free carboxylic acid group in the molecule which can react with a polyvalent metal salt, obtained with a dispersing agent consisting essentially of a water-soluble salt of a fatty acid containing at least 10 carbon atoms;

b. incorporating in the resulting mixture a precipitating agent consisting essentially of a water-soluble polyvalent metal salt, which precipitates the water-insoluble polyvalent metal salt of the fatty acid, and breaks the dispersion, whereby the explosive particles are covered with a coating consisting essentially of an intimate composite of the wax and the insoluble polyvalent salt of said acid;

c. separating the coated explosive particles from the aqueous medium; and d. drying the coated explosive particles;

and wherein the amount of said coating ranges from 1 to 20% by weight of the particulate explosive.

2. The process of claim 1, wherein the fatty acid is selected from the group consisting of stearic acid, linoleic acid and oleic acid and mixtures thereof.

3. The process of claim 1, wherein the polyvalent metal salt is barium chloride.

4. The process of claim 1, wherein the wax is an ethylene-acrylic acid copolymer.

5. The process of claim 1, wherein the particulate explosive is selected from the group consisting of cyclotrimethylenetrinitramine, cyclotetramethylenetetranitramine and pentaerythritol tetranitrate and mixtures thereof.

* * * * *